US010535960B2

(12) United States Patent
Meier et al.

(10) Patent No.: US 10,535,960 B2
(45) Date of Patent: Jan. 14, 2020

(54) PLUG CONNECTOR MODULE HAVING SPRING LINKS

(71) Applicant: HARTING Electric GmbH & Co. KG, Espelkamp (DE)

(72) Inventors: Heiko Meier, Minden (DE); Norbert Kropiewnicki, Bielefeld (DE); Martin Schmidt, Lübbecke (DE); Michael Przyborowski, Bielefeld (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/470,372

(22) PCT Filed: Feb. 14, 2018

(86) PCT No.: PCT/DE2018/100128
§ 371 (c)(1),
(2) Date: Jun. 17, 2019

(87) PCT Pub. No.: WO2018/153405
PCT Pub. Date: Aug. 30, 2018

(65) Prior Publication Data

US 2019/0312391 A1 Oct. 10, 2019

(30) Foreign Application Priority Data

Feb. 27, 2017 (DE) ..... 10 2017 103 996

(51) Int. Cl.
*H01R 13/70* (2006.01)
*H01R 13/703* (2006.01)
(Continued)

(52) U.S. Cl.
CPC ..... *H01R 13/7032* (2013.01); *H01R 13/4223* (2013.01); *H01R 13/506* (2013.01);
(Continued)

(58) Field of Classification Search
CPC ..... H01R 13/7032; H01R 13/4223; H01R 13/506
(Continued)

(56) References Cited

U.S. PATENT DOCUMENTS 4,685,887 A * 8/1987 Hanning ..... H01R 13/7032 200/51.1
4,894,019 A * 1/1990 Howard ..... H01H 13/12 200/51.09
(Continued)

FOREIGN PATENT DOCUMENTS

DE 3144580 A1 5/1983
DE 3442056 A1 5/1986
(Continued)

*Primary Examiner* — Alexander Gilman
(74) *Attorney, Agent, or Firm* — Smartpat PLC

(57) ABSTRACT

A system comprises a first plug connector module and a second plug connector module. The plug connector modules each have at least two contact elements. The first plug connector module has at least one spring link. In the unplugged state, the at least one spring link connects the at least two contact elements of the first plug connector module electrically conductively to each other. A method for plugging a first plug connector module with a second plug connector module is based on the first and the second plug connector modules being guided toward each other in the plug-in direction. A sliding element of the second plug connector module presses against at least one spring link of the first plug connector module and, as a result, the at least one spring link is brought out of touching contact with at least two associated socket contacts.

13 Claims, 2 Drawing Sheets

(51) Int. Cl.

| | |
|---|---|
| ***H01R 13/422*** | (2006.01) |
| ***H01R 13/506*** | (2006.01) |
| ***H01R 13/514*** | (2006.01) |
| ***H01R 13/518*** | (2006.01) |
| *H01R 31/08* | (2006.01) |
| *H01R 107/00* | (2006.01) |

(52) U.S. Cl.
CPC ..... *H01R 13/514* (2013.01); *H01R 13/518* (2013.01); *H01R 31/08* (2013.01); *H01R 2107/00* (2013.01); *H01R 2201/26* (2013.01)

(58) Field of Classification Search
USPC ..... 439/345
See application file for complete search history.

(56) References Cited

U.S. PATENT DOCUMENTS 4,906,203 A * 3/1990 Margrave ..... H01R 13/7032 439/188
4,988,307 A * 1/1991 Muzslay ..... H01R 24/84 439/188
5,505,631 A * 4/1996 Schauer ..... F42C 19/06 200/51.1
5,518,414 A * 5/1996 Antonini ..... H01R 24/46 200/51.1
5,674,084 A * 10/1997 Fukamachi ..... H01R 13/7032 200/51.1
5,897,389 A * 4/1999 Dietz ..... H01R 13/7032 439/188
7,955,104 B1 * 6/2011 Wicks ..... H01R 13/7032 439/188
8,647,140 B2 2/2014 Annecke
8,753,135 B2 * 6/2014 Cheng ..... H01R 31/08 439/188
9,054,457 B2 * 6/2015 Odorfer ..... F42B 3/26
9,537,267 B2 * 1/2017 Odorfer ..... H01R 13/641
10,236,640 B2 * 3/2019 Pamart ..... H01R 13/11
2007/0049084 A1 * 3/2007 Geismayr ..... H01R 13/7032 439/188
2011/0217880 A1 * 9/2011 Schmidt ..... H01R 13/506 439/676
2016/0285211 A1 * 9/2016 Tedeschi ..... H01R 13/6271

FOREIGN PATENT DOCUMENTS

DE 4428323 A1 2/1995
DE 102005041472 A1 3/2007
DE 102013113975 A1 6/2015
DE 102016204743 A1 9/2016
EP 2510590 B1 4/2014

* cited by examiner

PLUG CONNECTOR MODULE HAVING SPRING LINKS

TECHNICAL FIELD

The disclosure relates to a system comprising a first plug connector module and a second plug connector module that may be plugged into said first plug connector module. The disclosure likewise relates to a method for plugging a plug connector module to a second plug connector module.

Systems of this type are used in current circuits that are not to be interrupted. Current circuits of this type are in particular found in safety technology and comprise by way of example transformers and/or inverters

BACKGROUND

EP 2 510 590 B1 discloses a heavy plug connector that may be fitted with various plug connector modules. The individual contact elements of the plug connector modules may be bridged via so-called adaptor elements.

However, this bridging arrangement is permanent and active as long as the adaptor element is attached on the plug connector module. The bridging arrangement cannot be interrupted in the plugged state. Plug connector modules of this type may therefore only be used in current circuits that may be at least temporarily interrupted if by way of example a plug connector that is connected is pulled out.

The German Patent and Trademark Office has researched the following prior art in the priority application with regard to the current application: DE 31 44 580 A1; DE 34 42 056 A1; DE 44 28 323 A1; DE 10 2005 041 472 A1 and DE 10 2016 204 743 A1.

SUMMARY

The object of the invention resides in proposing a system of two plug connector modules, which may be used in current circuits that are not to be interrupted.

The object is achieved by the system and the method as claimed.

The system comprises a first plug connector module and a second plug connector module that may be plugged into said first plug connector module. Plug connector modules of this type are used in so-called heavy plug connectors that may be fitted in a modular manner with various types of plug connector modules.

The plug connector modules are in general attached in a holding frame that is subsequently installed in a plug connector housing. Such a holding frame is disclosed by way of example in DE 10 2013 113 975 A1.

The plug connector modules comprise respectively at least two contact elements. In this case, these are preferably electrical contact elements that are embodied from a metal basic material having a particularly conductive metal alloy that is applied to said basic material. The first plug connector module comprises at least one spring bridge, wherein in the unplugged state, the at least one spring bridge connects the at least two contact elements of the first plug connector module to one another in an electrically conductive manner. This means that the spring bridge is produced from a conductive material and, in the unplugged state of the first plug connector module, is in physical contact with the at least two contact elements.

The spring bridge is advantageously arranged between the two contact elements. The spring bridge is embodied from resilient elastic electrically conductive material. In the unplugged state, the spring bridge presses on one side against a first contact element and on the other side against a second contact element, as a result of which a so-called electrical bridging arrangement is provided between the contact elements. This arrangement is particularly effective at saving space.

The plug connector module advantageously comprises at least four contact elements and at least two spring bridges. A spring bridge is arranged respectively between two contact elements.

It is preferred that the spring bridge is produced in a stamping and bending method. The spring bridge is embodied in a mirror-symmetrical manner along its main axis of symmetry. The spring bridge is ideally embodied as omega-shaped, wherein the ends are curved inward in order to place the surface of the contact element or contact elements under as small a mechanical load as possible if the two are brought into physical contact with one another.

In one advantageous embodiment, the contact elements comprise a contact region and a connecting region. Conductors of a cable that is to be connected on the plug connector are connected on the connecting region of the contact element. In this case, by way of example the crimping technique is used. The contact region of the contact element makes physical contact with a contact element of an opposite-lying plug connector module as soon as the plug connector modules are plugged to one another. In the unplugged state, the at least one spring bridge connects the at least two contact elements of the first plug connector module to one another in the connecting region in an electrically conductive manner. A physical contacting arrangement is produced with the spring bridge in the connecting region of the two contact elements. Producing the physical contacting arrangement remote from the contact region of the contact elements has the advantage that the metal alloy of the contact element is preserved in the contact region. As a consequence, multiple plug cycles may be achieved using the plug connector module. The contact region of the contact elements is mechanically loaded during the plugging procedure. An additional loading by means of a spring bridge in this region would lead to an accelerated wear of the relevant contact elements.

In one advantageous embodiment, the second plug connector module comprises a sliding element. If the first and the second plug connector module are plugged to one another, the sliding element disconnects the electrically conductive connection between the two contact elements of the first plug connector module and the spring bridge that is arranged therebetween. The physical contacting arrangement between the contact elements and the spring bridge is interrupted.

It is preferred that the sliding element is embodied in the second plug connector module as U-shaped. The ends of the omega-shaped spring bridge may be simultaneously brought out of the physical contacting arrangement with the associated contact elements by means of the U-shape. Moreover, it is possible by means of the U-shape in the second plug connector module to reach the connecting region of the contact elements in the first plug connector module.

It is particularly advantageous if the first plug connector module comprises at least two, however preferably four, contact elements that are embodied as socket contacts. As a consequence, the first plug connector module may be mounted in a so-called mounting flange on a system and/or machine. Since a mounting flange in contrast to a plug connector is placed under a smaller mechanical load, because said mounting flange cannot fall out, the first plug connector module is also mechanically preserved. Consequently, the second plug connector module comprises at least two, however preferably four, contact elements that are embodied as pin contacts.

It is advantageous if the first plug connector module comprises at least one holding plate that fixes the at least one spring bridge within the first plug connector module. This fixing arrangement is ideally provided on the interface of the axis of symmetry of the spring bridge. The spring element comprises resilient elastic arms to the left-hand side and right-hand side of the fixing region and said resilient elastic arms respectively may be pressed against a contact element.

The holding plate advantageously assumes a double function. The holding plate fixes both the spring bridge as well as the two associated contact elements in the first plug connector module. This simple construction makes the first plug connector module equally robust and cost effective to produce.

The two above-mentioned plug connector modules are plugged to one another. In this case, the first and the second plug connector module are guided to one another in the plugging direction. A sliding element of the second plug connector module in this case presses against at least one spring bridge of the first plug connector module. As a consequence, the at least one spring bridge is brought out of the physical contacting arrangement with at least two associated socket contacts. The contact elements of the first plug connector module and the contact elements of the second plug connector module are brought into physical contact. The pin contacts of the second plug connector module are inserted in this case into the socket contacts of the first plug connector module. This occurs prior to the at least one spring bridge being brought out of the physical contacting arrangement with the at least two associated socket contacts.

BRIEF DESCRIPTION OF THE DRAWINGS

An exemplary embodiment is illustrated in the drawings and is further explained below.

DETAILED DESCRIPTION

Figure 1:
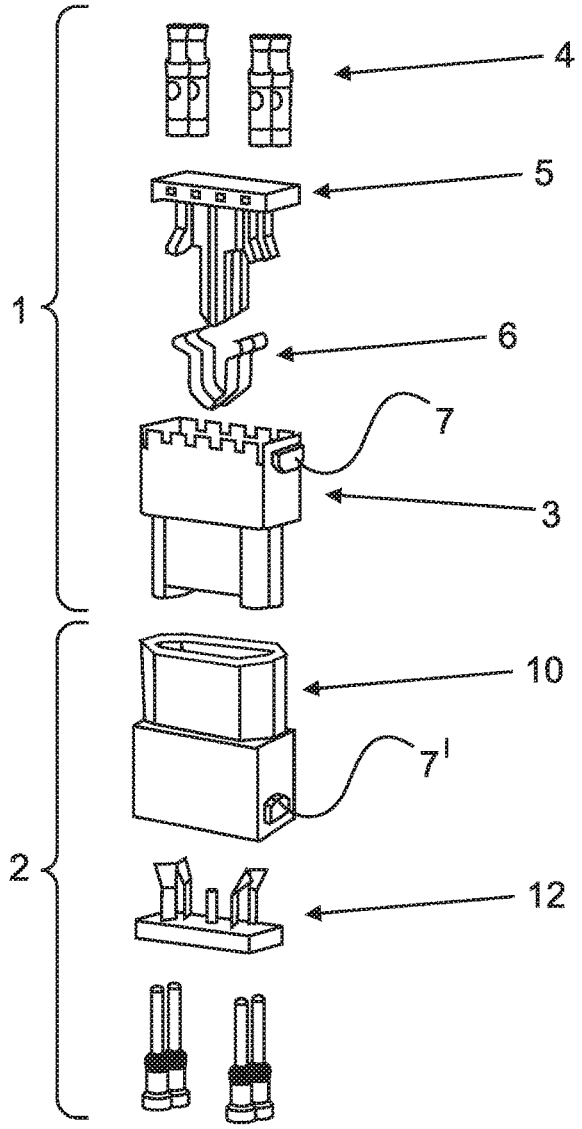
FIG. 1 illustrates a perspective exploded view of a system of a first and a second plug connector module.
Figure 2:
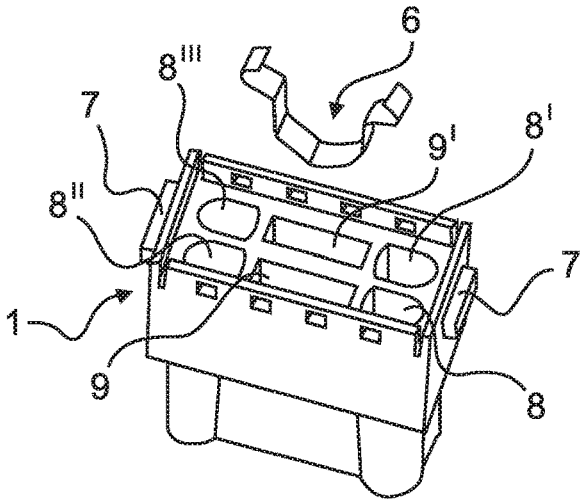
FIG. 2 illustrates a perspective view of a first plug connector module having a released spring bridge.

The figures include in part simplified, schematic illustrations. In part, identical reference numerals are used for identical but where applicable non-identical elements. Various views of the same elements could be scaled differently.

FIG. 1 illustrates an exploded view of a first plug connector module 1 and a second plug connector module 2. The first plug connector module 1 comprises a base body 3 in which four contact elements are arranged, said contact elements being embodied as a socket contact 4, a holding plate 5 and two spring bridges 6.

The first plug connector module 1 comprises on its outer side holding lugs 7 via which the first plug connector module 1 may be fixed in a holding frame (not illustrated) of a heavy plug connector (not illustrated) or of a mounting flange (not illustrated). The first plug connector module comprises cylindrical, first openings 8, 8', 8", 8''' in which socket contacts 4 may be fixed. The first plug connector module 1 comprises therebetween cuboid-shaped, second openings 9, 9' in which a spring bridge 6 may be respectively fixed. In the unplugged state, a spring bridge 6, 6' is respectively in physical contact with two socket contacts. Such a physical contacting arrangement is circled in FIG. 4 as the physical contact region 14. The physical contact region 14 is located in the connecting region of the individual contact elements or socket contacts 4, 4', 4", 4'''. This region is otherwise mechanically loaded to a small extent with the result that a contacting arrangement, which is provided frequently with the end regions of the respective spring bridge 6, 6', does not have an influence on the conductivity of the contact elements.

The second plug connector module comprises a base body 10, four contact elements that are arranged therein, in this case pin contacts 11, and a holding plate 12. The pin contacts 11 are fixed via the holding plate 12 in the base body 10. A sliding element 13 is formed in the second plug connector module 2. It is possible via the sliding element 13 to bring the spring bridge 6 of the first plug connector module 1 out of the physical contacting arrangement with the socket contacts 4. The precise manner in which this functions is explained more precisely below. The second plug connector module 2 also comprises holding lugs 7' for fixing in a holding frame (not illustrated).

Figure 3:
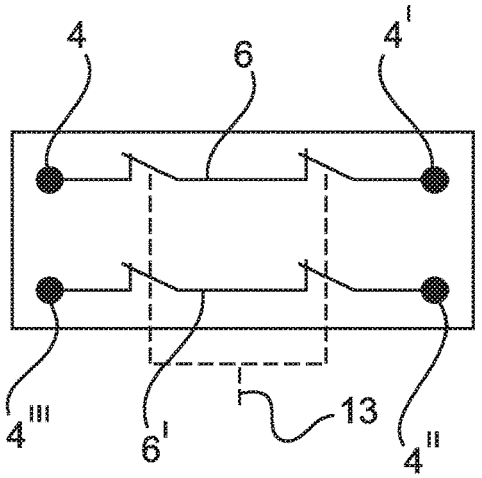
FIG. 3 illustrates a circuit diagram of a first plug connector module in the unplugged state.

FIG. 3 illustrates a switching function of the first plug connector module 1. In the unplugged state, the socket contacts 4, 4', 4", 4" of the first plug connector module are short circuited by means of the spring bridges 6, 6' that are installed in pairs. The spring bridges 6, 6' in this case are only illustrated schematically in FIG. 3. A bridging arrangement is provided between the socket contact 4 and the socket contact 4'. A second bridging arrangement is embodied between the socket contact 4" and the socket contact 4'''.

The sliding element 13 is only indicated schematically in FIG. 3. The pin contacts and socket contacts protrude ahead of the spring bridges and form a contacting arrangement with one another prior to the spring bridges 6, 6' being separated. As a consequence, it is ensured that the current circuit in which the first plug connector module 1 is integrated is never interrupted.

Figure 4:
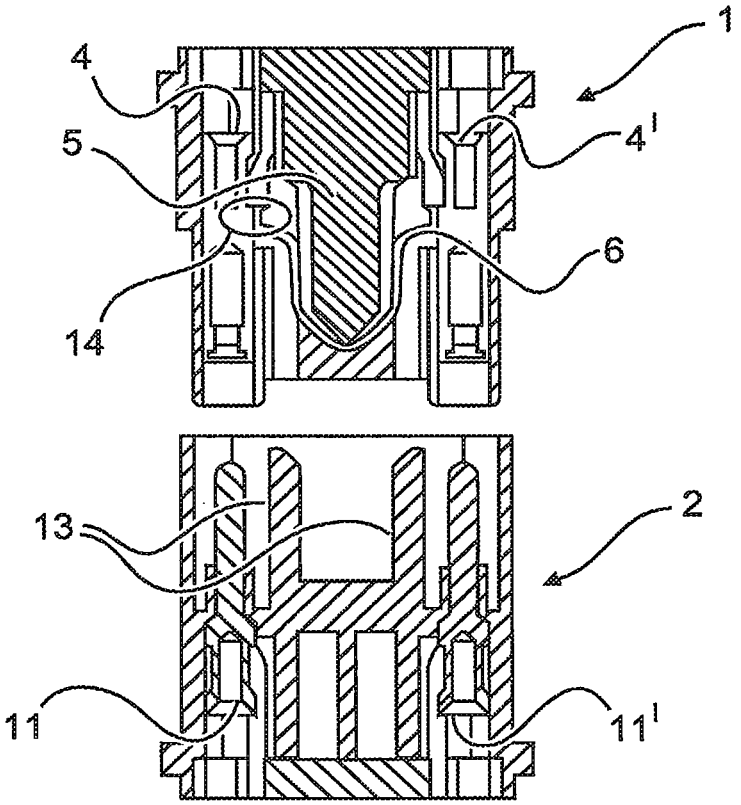
FIG. 4 illustrates a sectional view of an unplugged system of a first and a second plug connector module.
Figure 5:
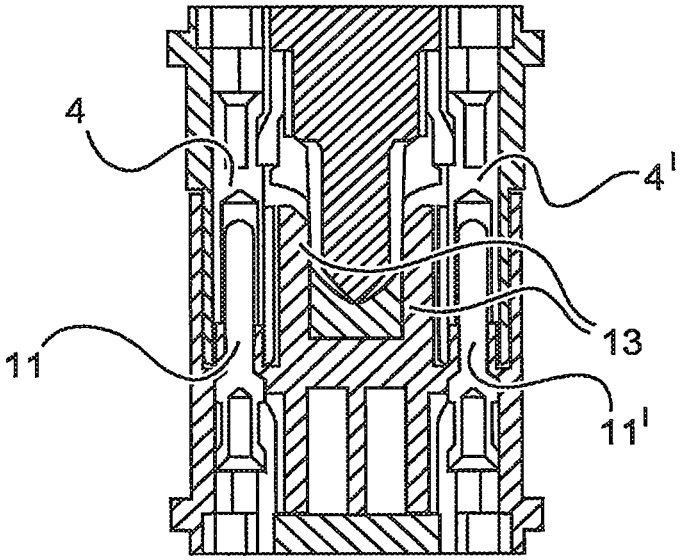
FIG. 5 illustrates a sectional view of the plugged system of a first and a second plug connector module.

The plugging procedure of the above-described plug connector modules is illustrated in the FIGS. 4 and 5 and is performed as follows. The first 1 and the second plug connector module 2 are plugged to one another. In this case, the sliding element 13 of the second plug connector module presses against the spring bridges 6, 6' of the first plug connector module. As a consequence, the spring bridge 6 or the spring bridges 6, 6' of the associated socket contacts 4, 4' and 4", 4''' are separated. However, prior to this the contact elements 4, 4' and 4", 4' of the first plug connector module 1 and the contact elements 11, 11' of the second plug connector module 2 are brought into physical contact. The contact elements 4, 4', 4", 4" of the first plug connector module 1 and the contact elements 11, 11' of the second plug connector module 2 contact one another prior to the bridging arrangement of the contact elements 4, 4' and 4", 4" of the first plug connector module 1 being interrupted. As a consequence, it is ensured that the current circuit in which the first plug connector module 1 is located is or may be interrupted.

LIST OF REFERENCE NUMERALS

1 First plug connector module
2 Second plug connector module

3 Base body
4 Socket contact
5 Holding plate
6 Spring bridge
7 Holding lug
8 First opening
9 Second opening
10 Base body
11 Pin contact
12 Holding plate
13 Sliding element
14 Physical contact region

The invention claimed is:

1. A system, comprising:

a first plug connector module and a second plug connector module that may be plugged to said first plug connector module, wherein the plug connector modules respectively comprise at least two contact elements, wherein the first plug connector module comprises at least one spring bridge having two elongated legs connected by a center portion, wherein the at least one spring bridge in an unplugged state connects the at least two contact elements of the first plug connector module to one another in an electrically conductive manner, wherein the first plug connector module comprises at least one holding plate that fixes the center portion of the at least one spring bridge within the first plug connector module, wherein the at least one spring bridge is arranged within the first plug connector module such that its center portion faces the second plug connector module and its elongated legs extend away from the second plug connector module, and wherein the at least one holding plate is inserted into the first plug connector module from a distal side facing away from the second plug connector.

2. The system as claimed in claim 1, wherein the contact elements comprise a contact region and a connecting region and wherein the at least one spring bridge in the unplugged state connects the at least two contact elements of the first plug connector module in the connecting region to one another in an electrically conductive manner.

3. The system as claimed in claim 1, wherein the spring bridge is arranged between the two contact elements.

4. The system as claimed in claim 1, wherein the first plug connector module comprises at least four contact elements and at least two spring bridges, and wherein a spring bridge is arranged respectively between two contact elements.

5. The system as claimed in claim 1, wherein the second plug connector module comprises a sliding element, which in a plugged state disconnects the electrically conductive connection between the two contact elements and the spring bridge that is arranged between said contact elements.

6. The system as claimed in claim 5, wherein the sliding element is embodied as U-shaped.

7. The system as claimed in claim 1, wherein the at least one spring bridge is embodied in a mirror-symmetrical manner along its main axis of symmetry.

8. The system as claimed in claim 1, wherein the at least one spring bridge is embodied as omega-shaped.

9. The system as claimed in claim 1, wherein the first plug connector module comprises at least two contact elements that are embodied as socket contacts.

10. The system as claimed in claim 1, wherein the second plug connector module comprises at least two contact elements that are embodied as pin contacts.

11. The system as claimed in claim 1, wherein the first plug connector module comprises four contact elements that are embodied as socket contacts.

12. The system as claimed in claim 1, wherein the second plug connector module comprises four contact elements that are embodied as pin contacts.

13. The system as claimed in claim 1, wherein the center portion of the at least one spring bridge is axially clamped between a body of the first plug connector module and the at least one holding plate.

* * * * *